US011326488B2

(12) United States Patent
Lewis et al.

(10) Patent No.: US 11,326,488 B2
(45) Date of Patent: May 10, 2022

(54) ZERO TURNING RADIUS MOWER OIL EXTENSION KIT

(71) Applicant: DEERE & COMPANY, Moline, IL (US)

(72) Inventors: Timothy J. Lewis, Angier, NC (US); Brian S. Buchholz, Sanford, NC (US); Casey L. Krause, Shakopee, MN (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/891,617

(22) Filed: Jun. 3, 2020

(65) Prior Publication Data

US 2021/0381408 A1 Dec. 9, 2021

(51) Int. Cl.
*F01M 11/04* (2006.01)

(52) U.S. Cl.
CPC ..... *F01M 11/0458* (2013.01)

(58) Field of Classification Search
CPC ..... F01M 11/0458
See application file for complete search history.

(56) References Cited

U.S. PATENT DOCUMENTS

| | | | | |
|---|---|---|---|---|
| 2,792,912 | A | 5/1957 | Kangas | |
| 3,447,636 | A | 6/1969 | Bonfilio | |
| 4,421,078 | A | 12/1983 | Hurner | |
| 4,674,456 | A | 6/1987 | Merritt | |
| 4,869,346 | A | 9/1989 | Nelson | |
| 5,238,085 | A | 8/1993 | Engelmann | |
| 5,701,862 | A | 12/1997 | Inoue et al. | |
| 5,964,318 | A | 10/1999 | Boyle et al. | |
| 5,970,942 | A | 10/1999 | Koeberlein et al. | |
| 7,669,576 | B2 | 3/2010 | Muramatsu | |
| 9,903,241 | B2 | 2/2018 | Hellman et al. | |
| 2013/0192558 | A1* | 8/2013 | Hodges | F01M 11/064 123/196 R |
| 2015/0053505 | A1 | 2/2015 | Klowak et al. | |
| 2019/0032527 | A1* | 1/2019 | May | F01M 11/02 |

OTHER PUBLICATIONS

Farm Equipment, "Zero-Turn Mowers Product Roundup 2018", Apr. 26, 2018, https://www.farm-equipment.com/articles/15499-zero-turn-mowers-product-roundup-2018 (Year: 2018).*

Vanguard Dramatically Extends Oil Change Intervals with New Oil Guard System, pp. 1-2, [online], [retrieved on Apr. 22, 2019], Retrieved from the Internet <URL: https://www.forconstructionpros.com/equipment/fleet-maintenance/gasoline-engines/press-release/1231>.

Ferris Introduces Oil Guard system on IS2100Z and IS3200Z, pp. 1-2, [online], [retrieved on Apr. 21, 2020], Retrieved from the Internet <URL: https://www.ferrismowers.eu/newsroom/ferris-introduces-oil-guard-system-is2100z-is3200z/>.

* cited by examiner

*Primary Examiner* — Kevin A Lathers

(57) ABSTRACT

A zero turning radius mower oil extension kit includes a supplemental oil tank that may be installed under a wet sump of a zero turning radius mower engine. A plurality of conduits may be installed between the supplemental oil tank and at least one drain port of the engine for continuously circulating a volume of oil between the supplemental oil tank and the wet sump of the engine while the engine is running. The kit extends the time between oil changes because of the increased volume of oil in the supplemental oil tank and the wet sump.

8 Claims, 4 Drawing Sheets

ZERO TURNING RADIUS MOWER OIL EXTENSION KIT

FIELD OF THE INVENTION

This invention relates generally to zero turning radius ("ZTR") mowers and specifically to an oil extension kit for ZTR mowers.

BACKGROUND OF THE INVENTION

ZTR mowers have two cylinder air-cooled internal combustion engines with displacements of about 500 cc up to 1000 cc. These engines typically hold an oil volume of about 1.5 L to about 2.5 L and require oil changes about every 100 hours. Commercial mowing operations use their ZTR mowers every day and must change the oil at least every month, which is unproductive down time. A ZTR mower oil extension kit is needed to extend the time interval between oil changes. A ZTR mower oil extension kit is needed to retrofit different engines on ZTR mowers, and that is low in cost.

U.S. Pat. No. 9,903,241 for Small Air-Cooled Engine Assembly with Dry Sump Lubrication System shows a system designed to extend time between oil changes. However, the system is only for specific dry sump engines, cannot be installed as a kit on ZTR mowers, and has costly additional components.

In the past, various systems have been proposed to automatically replenish engine oil when certain conditions are met, such as low oil level, high engine temperature, poor oil quality, prolonged engine usage, or actuation of an oil change switch. For example, U.S. Pat. No. 2,792,912 for Automatic Control System for Lubricant Supply, U.S. Pat. No. 3,447,636 for Automatic Oil Exchanging System, U.S. Pat. No. 4,674,456 for Oil-Changing System for an Internal Combustion Engine, U.S. Pat. No. 4,869,346 for Automatic Crankcase Oil Change and Makeup System, U.S. Pat. No. 5,238,085 for Engine Oil Makeup and Extended Operation Oil Exchange System, U.S. Pat. No. 5,701,862 for Method and Apparatus for Replenishing the Lubricating Oil of an Internal Combustion Engine, and U.S. Pat. No. 5,964,318 for System for Maintaining the Quality and Level of Lubricant in an Engine relate to systems that provide fresh oil from a reservoir to a wet sump. However, each of these systems is costly and complex, and cannot be installed as a retrofit kit on a ZTR mower.

SUMMARY OF THE INVENTION

A zero turning radius mower oil extension kit includes a supplemental oil tank mounted below an engine sump of a rear mounted zero turning radius mower engine. Oil from the engine sump completely fills the supplemental oil tank while the engine is running. An overflow of oil continuously flows from the supplemental oil tank back to the engine sump.

DESCRIPTION OF THE PREFERRED EMBODIMENT

Figure 1A:
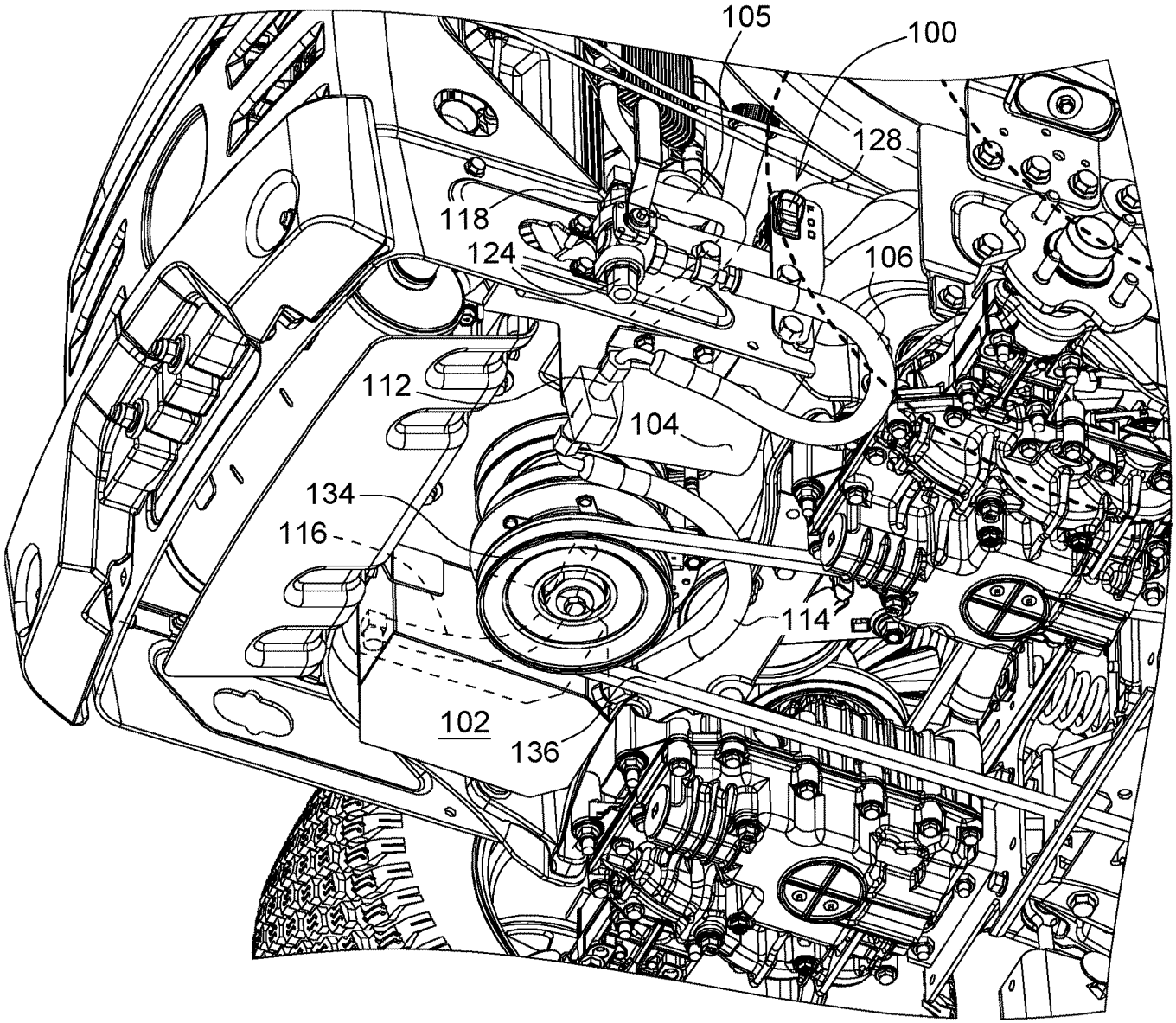
FIG. 1A is a perspective view of a zero turning radius mower oil extension kit according to a first embodiment of the invention.

In a first embodiment shown in FIGS. 1A and 1B, ZTR mower oil extension kit 100 may include supplemental oil tank 102 below wet sump case 122 of engine 120. The supplemental oil tank is mounted at a location on the ZTR mower frame that is preferably below the bottom of the wet sump case during use of the ZTR mower including use on steep slopes. However, the supplemental oil tank also may be mounted so that it is above the bottom of the sump but below the oil level in the sump. The supplemental oil tank may be welded steel or other material and may hold a liquid volume of oil from about 2.5 L to about 3 L. As a result, the ZTR mower oil extension kit may be installed as a retrofit kit on ZTR mower engines to increase total oil volume up to about 4.5 L to about 5 L, extending the time between oil changes. Engine 120 may be any rear mounted two cylinder air-cooled gasoline engine having a displacement of about 500 cc to about 1000 cc, and first and second drain ports 108, 110. The engine may have a vertical driveshaft for pulley 134 to engage belt 136 for rotating two or more rotary mower blades.

Figure 1B:
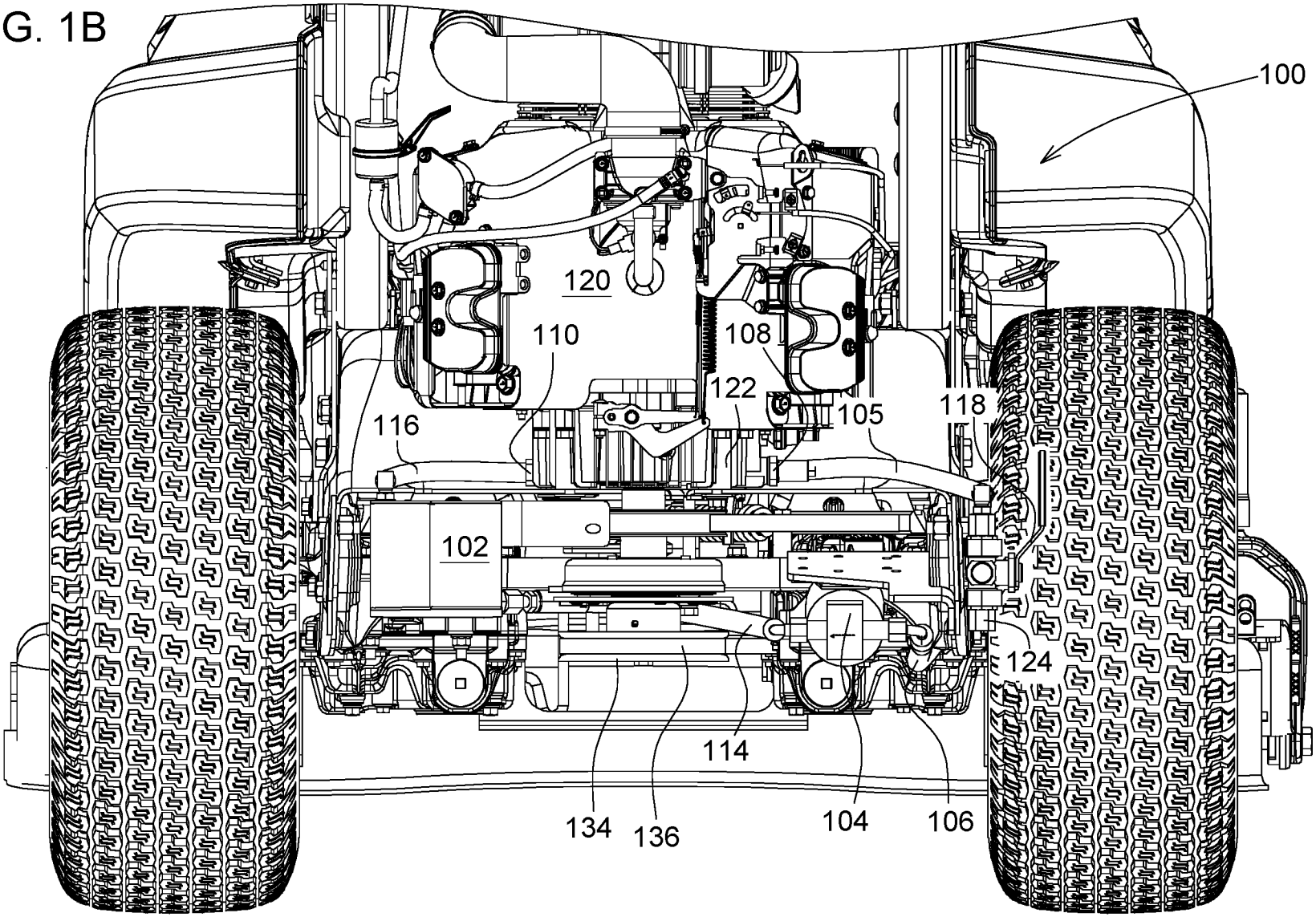
FIG. 1B is a rear view of a zero turning radius mower oil extension kit according to a first embodiment of the invention.

In a first embodiment shown in FIGS. 1A and 1B, ZTR mower oil extension kit 100 may include oil circulation pump 104 that continuously removes oil from engine sump 122 and pumps the removed oil into supplemental oil tank 102 while the engine is running. For example, the oil circulation pump may be a positive displacement pump with a capacity of about 0.75 LPM to about 1.5 LPM, powered by the ZTR mower's 12 VDC electrical system. The oil circulation pump ensures the supplemental oil tank stays completely filled with oil and without any air space, and continuously forces oil in the supplemental oil tank to overflow back into the engine sump while the engine is running.

In a first embodiment shown in FIGS. 1A and 1B, ZTR mower oil extension kit 100 may include a plurality of conduits such as hoses between engine sump 122 and supplemental oil tank 102. First hose 105 may connect first drain port 108 to three-way valve 118. Second hose 106 may connect three-way valve 118 to oil circulation pump 104. Third hose 114 may connect oil circulation pump 104 to supplemental oil tank 102. Fourth hose 116 may connect supplemental oil tank 102 to second drain port 110.

In a first embodiment shown in FIGS. 1A and 1B, ZTR mower oil extension kit 100 also may include switch 128 to reverse direction of oil circulation pump 104. In a first position of the switch, the oil circulation pump may pump oil from the engine sump into the supplemental oil tank. In a second position, the oil circulation pump may be used to fill the engine sump. Three-way valve 118 also may be used to drain oil from the engine sump and supplemental oil tank to drain port 124.

In a second embodiment shown in FIGS. 2A and 2B, ZTR mower oil extension kit 200 may include supplemental oil tank 202 below engine sump 222. The engine may have a vertical driveshaft with drive pulley 234 engaging belt 236 which rotates two or more rotary mower blades. The engine sump may include oil pump 204 to provide pressurized lubrication of the engine, and also to continuously pump oil into the supplemental oil tank while the engine is running. Oil pump 204 may fill the supplemental oil tank completely whereby the supplemental oil tank does not have any air space. Oil overflow from the supplemental oil tank may continuously flow back into the engine sump while the engine is running.

Figure 2A:
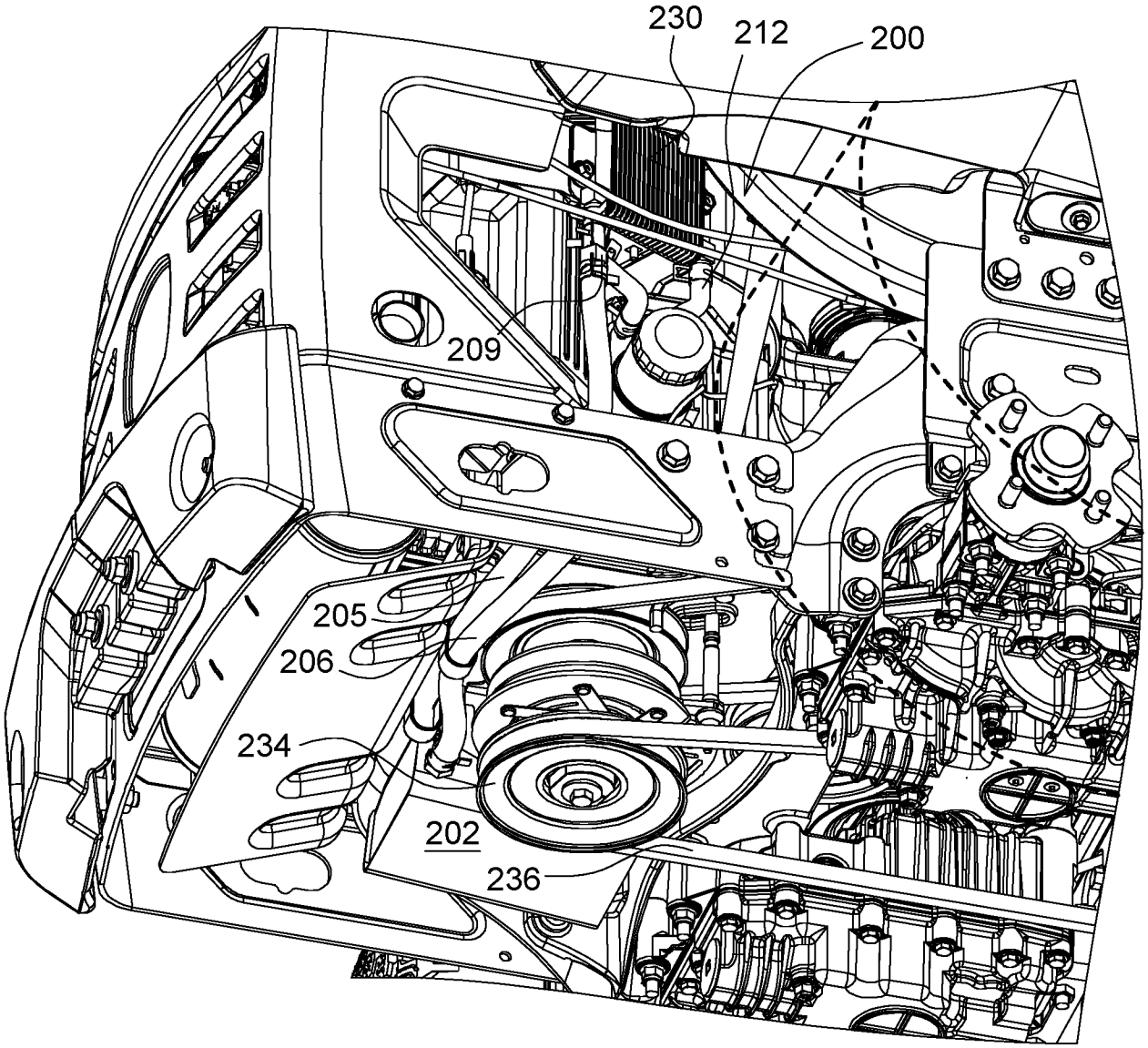
FIG. 2A is a perspective view of a zero turning radius mower oil extension kit according to a second embodiment of the invention.
Figure 2B:
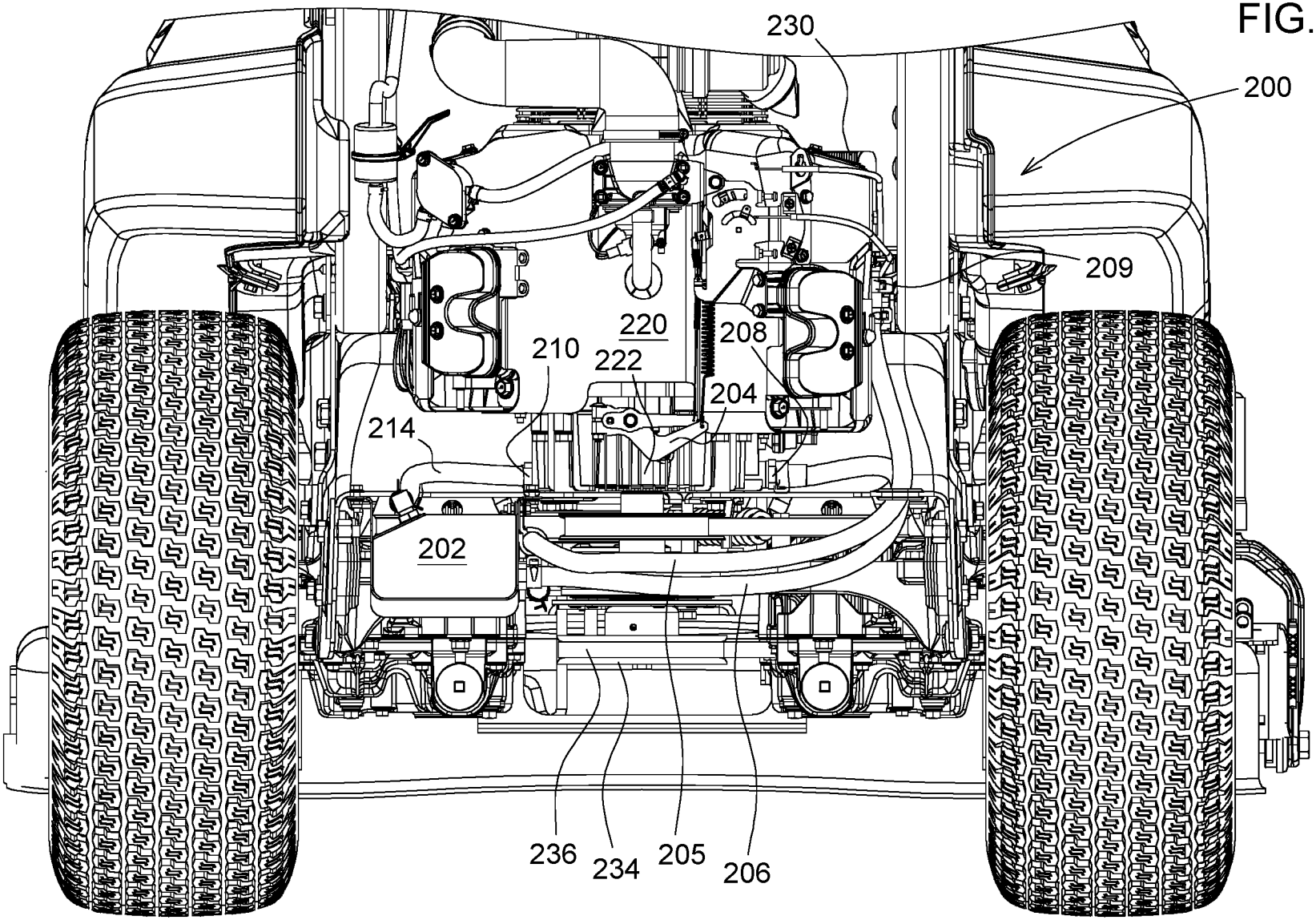
FIG. 2B is a rear view of a zero turning radius mower oil extension kit according to a second embodiment of the invention.

In a second embodiment shown in FIGS. 2A and 2B, oil pump 204 may pump oil from engine sump 222 to oil cooler 230 for the engine lubrication system. T-connection 209 may redirect some oil flow through conduit or hose 205 to supplemental oil tank 202 instead of the oil cooler. Oil flow from the engine sump to the supplemental oil tank may be restricted by an orifice. Conduit or hose 214 may be connected between supplemental oil tank 202 and drain port 210, for oil flow from the supplemental oil tank to the engine sump. Additionally, conduit or hose 206 may be connected between supplemental oil tank 202 and drain port 208, for additional oil flow from the supplemental oil tank to the engine sump. Hose 206 also may speed up fill time for changing oil, because air may flow through either hose 206 or 214 from the supplemental tank into the sump, while oil flows through the other hose from the sump into the supplemental tank. Hose 206 also may help drain oil from the sump into the supplemental tank when changing the oil. Another hose (not shown) may connect the supplemental oil tank to a drain port to drain oil from the supplemental tank and engine sump when changing the oil.

Having described the preferred embodiments, it will become apparent that various modifications can be made without departing from the scope of the invention as defined in the accompanying claims.

The invention claimed is:

1. A zero turning radius mower oil extension kit, comprising:

a supplemental oil tank mounted below an engine sump of a rear mounted zero turning radius mower engine;

an oil pump that continuously pumps a sufficient volume of oil from a drain port of the engine sump to keep the supplemental oil tank full while the engine is running, and forcing any excess volume of oil from the supplemental oil tank back to the engine sump.

2. The zero turning radius mower oil extension kit of claim 1 wherein the oil pump is in the engine sump.

3. The zero turning radius mower oil extension kit of claim 1 wherein the oil pump is an electric pump.

4. The zero turning radius mower oil extension kit of claim 1 further comprising a restricted orifice in a conduit between the oil pump and the supplemental oil tank.

5. A zero turning radius mower oil extension kit, comprising:

a supplemental oil tank mounted underneath a wet sump of a zero turning radius mower engine;

an oil circulation pump that continuously removes oil from the engine sump and pumps the removed oil to either an oil cooler or the supplemental oil tank whereby the supplemental oil tank stays completely filled without any air space;

an orifice limiting an oil flow from the wet sump of the engine to the supplemental oil tank;

a first conduit from the supplemental oil tank back to a first drain port of the engine; and a second conduit from the supplemental oil tank back to a second drain port of the engine.

6. A zero turning radius mower oil extension kit, comprising:

a supplemental oil tank installed under a wet sump of a zero turning radius mower engine;

a plurality of conduits installed between the supplemental oil tank and at least one drain port of the engine for continuously circulating a volume of oil between the supplemental oil tank and the wet sump of the engine while the engine is running;

the volume of oil completely filling the supplemental oil tank and forcing any overflow of oil to the wet sump.

7. The zero turning radius mower oil extension kit of claim 6, further comprising an oil pump in the wet sump.

8. The zero turning radius mower oil extension kit of claim 7 wherein the oil pump is reversible.

* * * * *